US011106166B2

(12) United States Patent
Tamai

(10) Patent No.: US 11,106,166 B2
(45) Date of Patent: Aug. 31, 2021

(54) HEATER AND IMAGE FORMING APPARATUS

(71) Applicant: Toshiba Lighting & Technology Corporation, Yokosuka (JP)

(72) Inventor: Masahiko Tamai, Ehime-ken (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 17/001,890

(22) Filed: Aug. 25, 2020

(65) Prior Publication Data

US 2021/0072682 A1 Mar. 11, 2021

(30) Foreign Application Priority Data

Sep. 11, 2019 (JP) ..... JP2019-165478

(51) Int. Cl.
*G03G 15/20* (2006.01)

(52) U.S. Cl.
CPC ..... *G03G 15/2053* (2013.01); *G03G 15/2039* (2013.01)

(58) Field of Classification Search
CPC ..... G03G 15/2017; G03G 15/2039; G03G 15/2053; G03G 2215/2003
See application file for complete search history.

(56) References Cited

U.S. PATENT DOCUMENTS 6,040,558 A * 3/2000 Yamazaki ..... G03G 15/2064 219/216
2009/0245900 A1* 10/2009 Kagawa ..... G03G 15/2042 399/329
2017/0185016 A1* 6/2017 Kadowaki ..... G03G 15/2039

FOREIGN PATENT DOCUMENTS

JP 2007-240606 A 9/2007

* cited by examiner

*Primary Examiner* — Thomas S Giampaolo, II
(74) *Attorney, Agent, or Firm* — Banner & Witcoff, Ltd.

(57) ABSTRACT

A heater includes: a substrate; a first heating element being provided on one surface of the substrate and extending in a longitudinal direction of the substrate; a second heating element being provided on one surface of the substrate, extending in the longitudinal direction of the substrate, and being provided side by side with the first heating element in a direction orthogonal to the longitudinal direction; a first detecting section being provided on one surface of the substrate and detecting a temperature; a wiring being electrically connected to one ends of the first heating element, the second heating element, and the first detecting section; a first terminal being electrically connected to the other end of the first heating element; a second terminal being electrically connected to the other end of the second heating element; and a third terminal being electrically connected to the other end of the first detecting section.

19 Claims, 8 Drawing Sheets

HEATER AND IMAGE FORMING APPARATUS

CROSS-REFERENCE TO RELATED APPLICATIONS

This application is based upon and claims the benefit of priority from Japanese Patent Application No. 2019-165478, filed on Sep. 11, 2019; the entire contents of which are incorporated herein by reference.

FIELD

Embodiments described herein relate generally to a heater and an image forming apparatus.

BACKGROUND

An image forming apparatus such as a copying machine or a printer is provided with a heater for fixing a toner. In general, such a heater includes an elongated substrate and a heating element provided on one surface of the substrate and extending in the longitudinal direction of the substrate. Further, in order to detect the temperature of such a heater, a technique in which the substrate is provided with a thermistor as a detecting section is proposed.

In this case, the detecting section is provided on the surface opposite to the surface provided with the heating element in the substrate. For that reason, heat generated in the heating element is transmitted to the detecting section through the substrate. Generally, since the substrate is formed of an insulating material such as aluminum oxide, the thermal conductivity is lower than that of the case of the substrate formed of metal or the like. For that reason, there is concern that a difference between the temperature in the vicinity of the heating element and the temperature in the vicinity of the detecting section increases. When the temperature difference increases, the temperature control may become complicated or the time required for the temperature control may become long.

In this case, when the heating element and the detecting section are provided on the same surface of the substrate, heat generated in the heating element is easily transmitted to the detecting section. Incidentally, when the heating element and the detecting section are provided on the same surface of the substrate, a wiring connected to the heating element and a wiring connected to the detecting section are also provided on the surface provided with the heating element and the detecting section in the substrate.

For that reason, when the heating element and the detecting section are provided on the same surface of the substrate, the width dimension of the substrate and further the width dimension of the heater increase. In recent years, it is desired to decrease the width dimension of the heater. For that reason, when the heating element and the detecting section are provided on the same surface of the substrate, a new problem arises in that the width dimension of the heater is difficult to decrease.

Therefore, it is desired to develop a technique capable of improving the temperature controllability of the heater and suppressing an increase in the width dimension of the heater.

DETAILED DESCRIPTION

Figure 1:
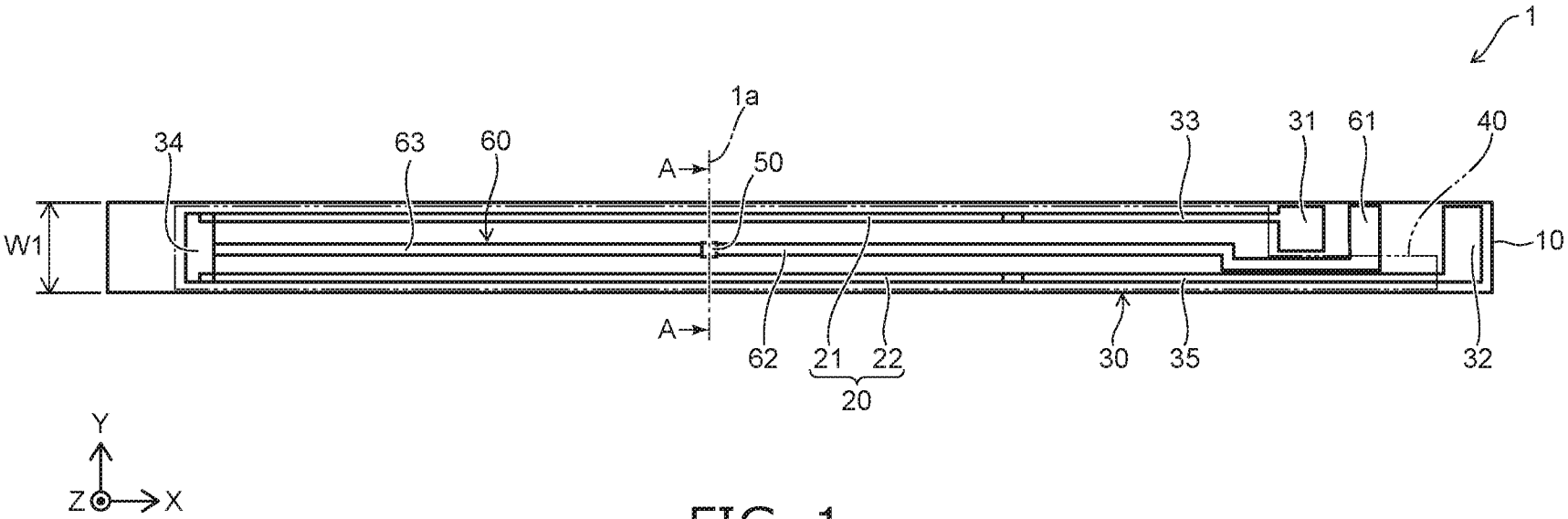
FIG. 1 is a schematic front view for illustrating a heater according to the present embodiment.

A heater according to an embodiment includes: a substrate; a first heating element which is provided on one surface of the substrate and extends in a longitudinal direction of the substrate; a second heating element which is provided on one surface of the substrate, extends in the longitudinal direction of the substrate, and is provided side by side with the first heating element in a direction orthogonal to the longitudinal direction; a first detecting section which is provided on one surface of the substrate and detects a temperature; a wiring which is electrically connected to one end of the first heating element, one end of the second heating element, and one end of the first detecting section; a first terminal which is electrically connected to the other end of the first heating element; a second terminal which is electrically connected to the other end of the second heating element; and a third terminal which is electrically connected to the other end of the first detecting section.

Hereinafter, embodiments will be described with reference to the drawings. Additionally, in the drawings, the same components will be indicated by the same reference numerals and detailed description thereof will be appropriately omitted. Further, arrows X, Y, and Z in each drawing indicate three directions orthogonal to one another. For example, the longitudinal direction of the substrate is an X direction, a lateral direction (a width direction) of the substrate is a Y direction, and a direction perpendicular to the surface of the substrate is a Z direction.

(Heater)

FIG. 1 is a schematic front view for illustrating a heater 1 according to the present embodiment.

FIG. 1 is a diagram in which the heater 1 is viewed from an installation side of a heating section 20 and a detecting section 50.

Figure 2:
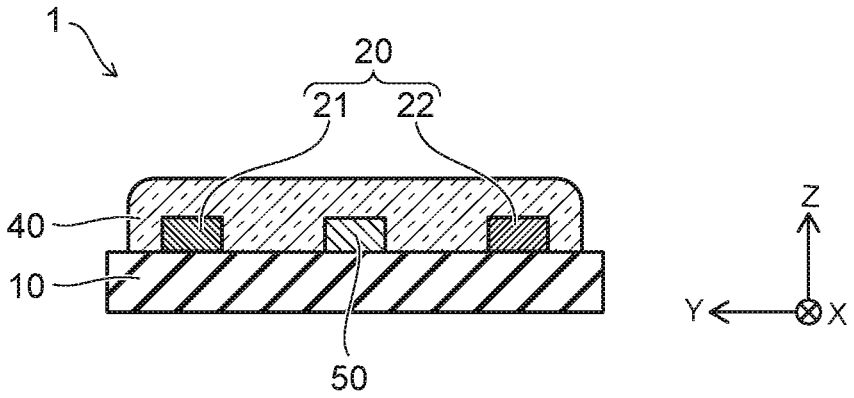
FIG. 2 is a schematic cross-sectional view taken along a line A-A of the heater of FIG. 1.

FIG. 2 is a schematic cross-sectional view taken along a line A-A of the heater 1 in FIG. 1.

As illustrated in FIGS. 1 and 2, a substrate 10, the heating section 20, a wiring section 30, an insulating section 40, the detecting section 50, and a wiring section 60 can be provided in the heater 1.

The substrate 10 can be one having a plate shape and extending in one direction (for example, the X direction). A planar shape of the substrate 10 can be, for example, an elongated rectangular shape. A thickness of the substrate 10 can be, for example, about 0.5 mm to 1.0 mm. A planar dimension of the substrate 10 can be appropriately changed in response to a size or the like of a heating target (for example, a sheet).

The substrate 10 can be formed of a material having heat resistance and insulation properties. The substrate 10 can be formed of, for example, ceramics such as aluminum oxide or aluminum nitride, crystallized glass (glass ceramics), or a metal plate whose surface is coated with an insulating material.

The heating section 20 can convert the applied power into heat (Joule heat).

The heating section 20 can include a heating element 21 (corresponding to an example of a first heating element) and a heating element 22 (corresponding to an example of a second heating element). Additionally, a case in which the heating element 21 and the heating element 22 are provided has been illustrated as an example, but the number and size of the heating element can be appropriately changed in response to a size or the like of a heating target. Further, a plurality of types of heating elements having different lengths, widths, shapes, and the like can be provided. That is, at least one heating element may be provided.

The heating element 21 and the heating element 22 can be provided on one surface of the substrate 10. The heating element 21 and the heating element 22 can be provided side by side in the Y direction (the lateral direction of the substrate 10) with a predetermined gap therebetween. The heating element 21 and the heating element 22 can have a shape extending in the X direction (the longitudinal direction of the substrate 10).

The dimension (length dimension) of the heating element 21 and the heating element 22 in the X direction can be made substantially the same. In this case, it is preferable that each of the centers of the heating element 21 and the heating element 22 be located on a straight line 1*a*. That is, it is preferable that each of the heating element 21 and the heating element 22 be provided so as to be line-symmetrical with the straight line 1*a* as the axis of symmetry.

When attaching the heater 1 to an image forming apparatus 100, the straight line 1*a* can be overlapped with a center line of a conveying path of the heating target. In this way, the heating target can be easily and substantially uniformly heated even when the dimension of the heating target in a direction orthogonal to a conveying direction changes.

Electric resistance values of the heating element 21 and the heating element 22 can be substantially the same or different. For example, when the dimensions (the length dimensions) in the X direction, the dimensions (the width dimensions) in the Y direction, and the dimensions (the thickness dimensions) in the Z direction of the heating element 21 and the heating element 22 are respectively substantially the same, the electric resistance values can be substantially the same. Further, the electric resistance values can be different by changing at least one of these dimensions. Further, the electric resistance values can be different by changing the materials.

Further, the electric resistance value per unit length of the heating element 21 can be substantially uniform in the X direction. For example, the dimension (the width dimension) in the Y direction and the dimension (the thickness dimension) in the Z direction of the heating element 21 can be substantially constant. The planar shape of the heating element 21 can be, for example, a substantially rectangular shape extending in the X direction (the longitudinal direction of the substrate 10).

Further, the electric resistance value per unit length of the heating element 22 can be substantially constant in the X direction. For example, the dimension (the width dimension) in the Y direction and the dimension (the thickness dimension) in the Z direction of the heating element 22 can be substantially constant. The planar shape of the heating element 22 can be, for example, a substantially rectangular shape extending in the X direction (the longitudinal direction of the substrate 10).

The heating element 21 and the heating element 22 can be formed by using, for example, ruthenium oxide ($RuO_2$) and silver-palladium (Ag—Pd) alloy. For example, the heating element 21 and the heating element 22 can be formed by applying a paste-like material onto the substrate 10 using a screen printing method or the like and curing the material using a firing method or the like.

The wiring section 30 can include a terminal 31 (corresponding to an example of a first terminal), a terminal 32 (corresponding to an example of a second terminal), a wiring 33, a wiring 34, and a wiring 35. The terminal 31, the terminal 32, the wiring 33, the wiring 34, and the wiring 35 can be provided on the surface provided with the heating element 21 and the heating element 22 in the substrate 10.

The terminals 31 and 32 can be provided in the vicinity of one end of the substrate 10 in the X direction. The terminals 31 and 32 can be provided side by side in the X direction. The terminals 31 and 32 can be electrically connected to, for example, a power-supply or the like via a connector, a wiring, and the like.

The wiring 33 can be provided on the side of the substrate 10 provided with the terminal 31 in the X direction. The wiring 33 can have a shape extending in the X direction. The wiring 33 can be electrically connected to the terminal 31 and the end of the heating element 21 on the side of the terminal 31.

The wiring 34 can be provided on the side opposite to the installation side of the terminals 31 and 32 in the substrate 10 in the X direction. The wiring 34 can be electrically connected to one end of the heating element 21, one end of the heating element 22, and one end of the detecting section 50.

The wiring 35 can be provided on the side of the substrate 10 provided with the terminal 32 in the X direction. The wiring 35 can have a shape extending in the X direction. The wiring 35 can be electrically connected to the terminal 32 and the end of the heating element 22 on the side of the terminal 32.

The wiring section 30 (the terminals 31 and 32 and the wirings 33 to 35) can be formed by using, for example, a material containing silver, copper, or the like. In this case, for example, the terminals 31 and 32 and the wiring 33 to 35 can be formed by applying a paste-like material onto the substrate 10 using a screen printing method or the like and curing the material using a firing method or the like.

The insulating section 40 can be provided to cover the heating section 20 (the heating elements 21 and 22), the detecting section 50, a part (the wiring 33 to 35) of the wiring section 30, and a part (the wirings 62 and 63) of the wiring section 60. In this case, the terminals 31 and 32 and the terminal 61 (corresponding to an example of a third terminal) can be exposed from the insulating section 40.

The insulating section 40 can have, for example, a function of insulating the heating section 20, the detecting section 50, a part of the wiring section 30, and a part of the wiring section 60, a function of transmitting heat generated in the heating section 20, and a function of protecting the heating section 20, the detecting section 50, or the like against an external force, corrosive gases, or the like. The insulating section 40 can be formed of a material having heat resistance and insulating properties and having high chemical stability. The insulating section 40 can be formed by using, for example, ceramics, glass, or the like. In this case, it is easy to form the insulating section 40 when using a glass to which filler containing a material having high thermal conductivity such as aluminum oxide is added. The thermal conductivity of the glass to which the filler is added can be, for example, 2 [W/(m·K)] or more.

The detecting section 50 can detect the temperature of the heater 1 (the heating elements 21 and 22). The detecting section 50 can have a film shape. The detecting section 50 can be, for example, a thermistor or the like. The detecting section 50 can be provided on the side of the substrate 10 provided with the heating section 20. For example, the detecting section 50 and the heating section 20 can be provided on the same surface of the substrate 10. At least one detecting section 50 can be provided. In the case of the example illustrated in FIG. 1, one detecting section 50 is provided. One end of the detecting section 50 can be electrically connected to a wiring 62. The other end of the detecting section 50 can be electrically connected to a wiring 63.

For example, the detecting section 50 can be formed by applying a paste-like material onto the ends of the wirings 62 and 63 using a screen printing method or the like and curing the material using a firing method or the like. When the detecting section 50 is a thermistor, the detecting section 50 can be formed by using, for example, a material containing barium titanate, a material containing an oxide, or the like. The oxide can be, for example, an oxide of nickel, manganese, cobalt, iron, or the like.

For example, the detecting section 50 can be provided in the vicinity of the center of the region provided with the heating section 20. However, the number, arrangement, and the like of the detecting sections 50 are not limited to those illustrated and can be appropriately changed in response to the size of the heater 1 (the substrate 10), the size of the region provided with the heating section 20, and the like.

The wiring section 60 can include a terminal 61, the wiring 62, and the wiring 63. The terminal 61, the wiring 62, and the wiring 63 can be provided on the surface provided with the detecting section 50 in the substrate 10.

The terminal 61 can be provided in the vicinity of the side of the substrate 10 provided with the terminals 31 and 32 in the X direction. The terminal 61 can be provided side by side with the terminals 31 and 32. For example, the terminal 61 can be provided between the terminal 31 and the terminal 32 in the X direction. As will be described later, at least one of the terminal 61, the terminal 31, and the terminal 32 can be electrically connected to, for example, a controller 210 of the image forming apparatus 100 via a connector, a wiring, and the like.

The wiring 62 can be provided between the wiring 33 and the wiring 35 in the Y direction. The wiring 62 can have a shape extending in the X direction. The wiring 62 can be electrically connected to the terminal 61 and the end of the detecting section 50 on the side of the terminal 61.

The wiring 63 can be provided between the heating element 21 and the heating element 22 in the Y direction. The wiring 63 can have a shape extending in the X direction. The wiring 63 can be electrically connected to the wiring 34 and the end of the detecting section 50 on the side of the wiring 34.

The wiring section 60 (the terminal 61, the wiring 62, and the wiring 63) can be formed by using, for example, a material containing silver, copper, or the like. In this case, for example, the wiring section 60 can be formed by applying a paste-like material onto the substrate 10 using a screen printing method or the like and curing the material using a firing method or the like.

Additionally, although a case in which one set of the terminal 61, the wiring 62, and the wiring 63 is provided is illustrated, the number, arrangement, form, and the like of the terminal and the wiring can be appropriately changed in response to the number, arrangement, and the like of the detecting section 50.

Next, the temperature controllability of the heater 1 according to the present embodiment will be described.

Figure 3:
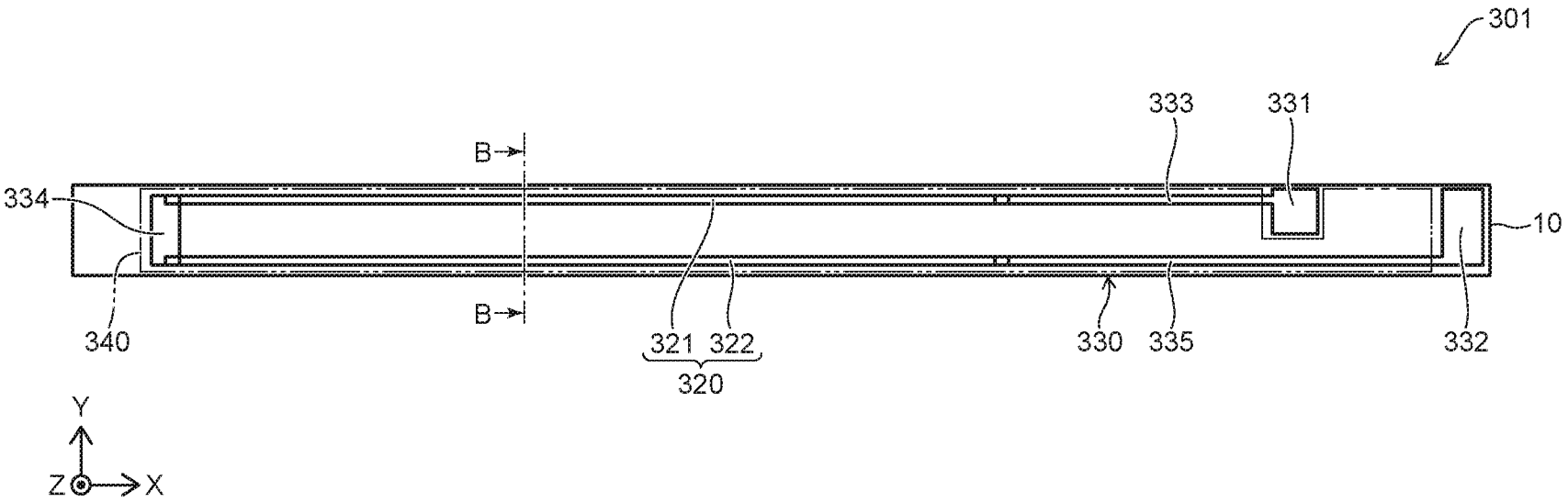
FIG. 3 is a schematic front view illustrating a heater according to a comparative example.

FIG. 3 is a schematic front view illustrating a heater 301 according to a comparative example.

FIG. 3 is a diagram in which the heater 301 is viewed from the installation side of a heating section 320.

Figure 4:
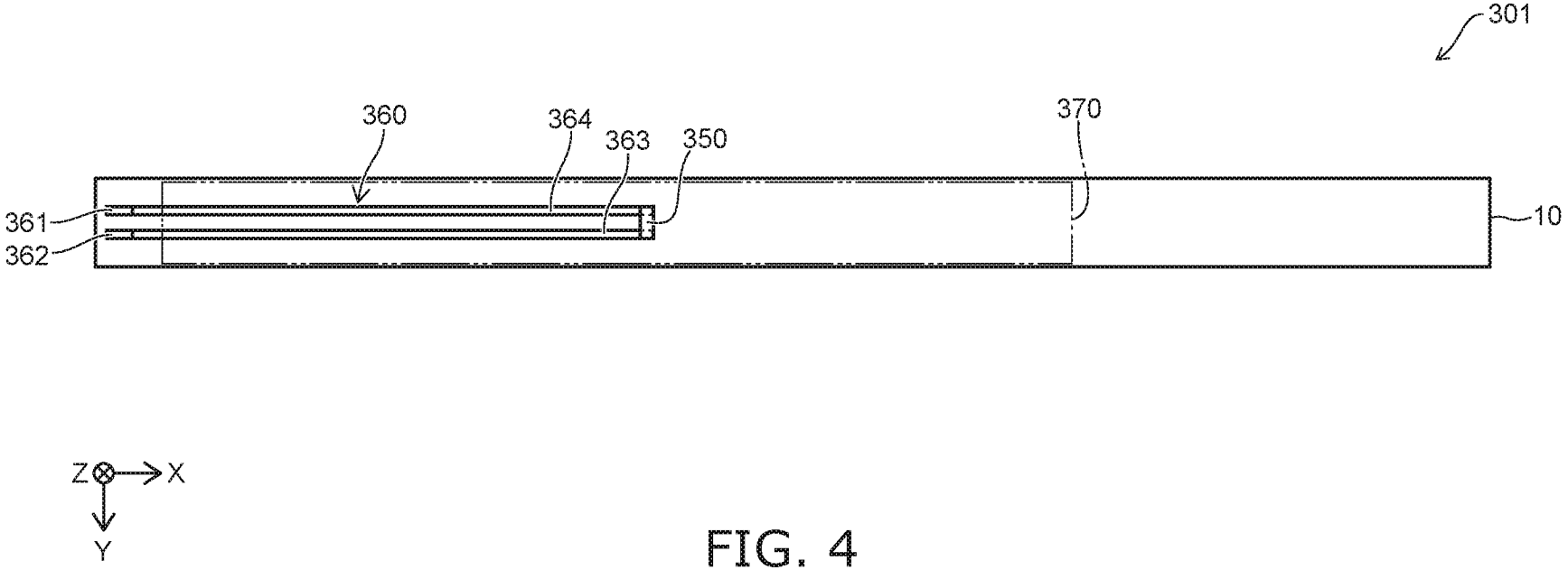
FIG. 4 is a schematic rear view illustrating the heater according to the comparative example.

FIG. 4 is a schematic rear view illustrating the heater 301 according to the comparative example.

FIG. 4 is a diagram in which the heater 301 is viewed from the installation side of a detecting section 350.

Figure 5:
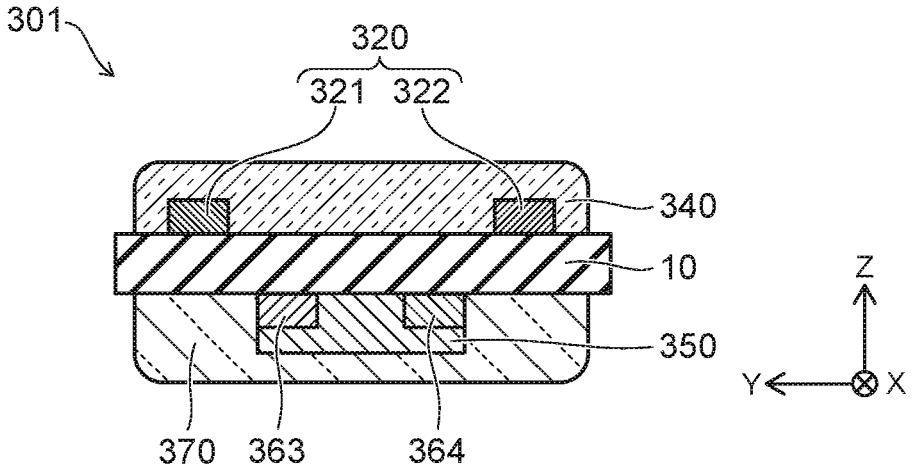
FIG. 5 is a schematic cross-sectional view taken along a line B-B of the heater of FIG. 3.

FIG. 5 is a schematic cross-sectional view taken along a line B-B of the heater 301 of FIG. 3.

As illustrated in FIGS. 3 to 5, the substrate 10, the heating section 320, a wiring section 330, an insulating section 340, the detecting section 350, a wiring section 360, and an insulating section 370 are provided in the heater 301.

The heating section 320 includes a heating element 321 and a heating element 322. The heating element 321 can be similar to the above-described heating element 21. The heating element 322 can be similar to the above-described heating element 22. The heating element 321 and the heating element 322 are provided on one surface of the substrate 10.

The wiring section 330 includes a terminal 331, a terminal 332, a wiring 333, a wiring 334, and a wiring 335. The terminal 331 can be similar to the above-described terminal 31. The terminal 332 can be similar to the above-described terminal 32. The wiring 333 can be similar to the above-described wiring 33. The wiring 334 can be similar to the above-described wiring 34. The wiring 335 can be similar to the above-described wiring 35. The terminal 331, the terminal 332, the wiring 333, the wiring 334, and the wiring 335 are provided on the surface provided with the heating section 320 in the substrate 10.

The insulating section 340 can be similar to the above-described insulating section 40. The insulating section 340 is provided on the surface provided with the heating section 320 in the substrate 10 and covers the heating section 320 (the heating elements 321 and 322) and a part (the wirings 333 to 335) of the wiring section 330. In this case, the terminals 331 and 332 can be exposed from the insulating section 340.

The detecting section 350 can be similar to the above-described detecting section 50. However, the detecting section 350 is provided on the surface opposite to the surface provided with the heating section 320 in the substrate 10.

The wiring section 360 includes a terminal 361, a terminal 362, a wiring 363, and a wiring 364. The terminals 361 and 362 can be similar to the above-described terminal 61. The wiring 364 can be similar to the above-described wiring 62. The wiring 363 can be similar to the above-described wiring 63. However, the terminal 361, the terminal 362, the wiring 363, and the wiring 364 are provided on the surface opposite to the surface provided with the heating section 320 in the substrate 10.

The insulating section 370 can be similar to the above-described insulating section 40. However, the insulating section 370 is provided on the surface opposite to the surface provided with the heating section 320 in the substrate 10 and covers the detecting section 350, the wiring 363, and the wiring 364.

That is, in the heater 301 according to the comparative example, the heating section 320 is provided on one surface side of the substrate 10 and the detecting section 350 is provided on the other surface side of the substrate 10.

In this case, heat generated in the heating elements 321 and 322 is transmitted to the detecting section 350 through the substrate 10. As described above, the substrate 10 is formed of a material having heat resistance and insulating properties such as ceramics. Such materials have lower thermal conductivity than metals. For that reason, there is concern that a difference between the temperature in the vicinity of the heating elements 321 and 322 and the temperature in the vicinity of the detecting section 350 increases. When the temperature difference increases, the temperature control may become complicated or the time required for the temperature control may become long.

On the contrary, in the case of the heater 1 according to the present embodiment, as illustrated in FIGS. 1 and 2, the detecting section 50 is provided on the surface provided with the heating section 20 in the substrate 10. For that reason, heat generated in the heating elements 21 and 22 is easily transmitted to the detecting section 50. As a result, a difference between the temperature in the vicinity of the heating elements 21 and 22 and the temperature in the vicinity of the detecting section 50 can be decreased. When the temperature difference can be decreased, the temperature control becomes easy and the time required for temperature control becomes short. That is, according to the heater 1 of the present embodiment, the temperature controllability of the heater 1 can be improved.

Next, the width dimension of the heater 1 according to the present embodiment will be described.

Figure 6:
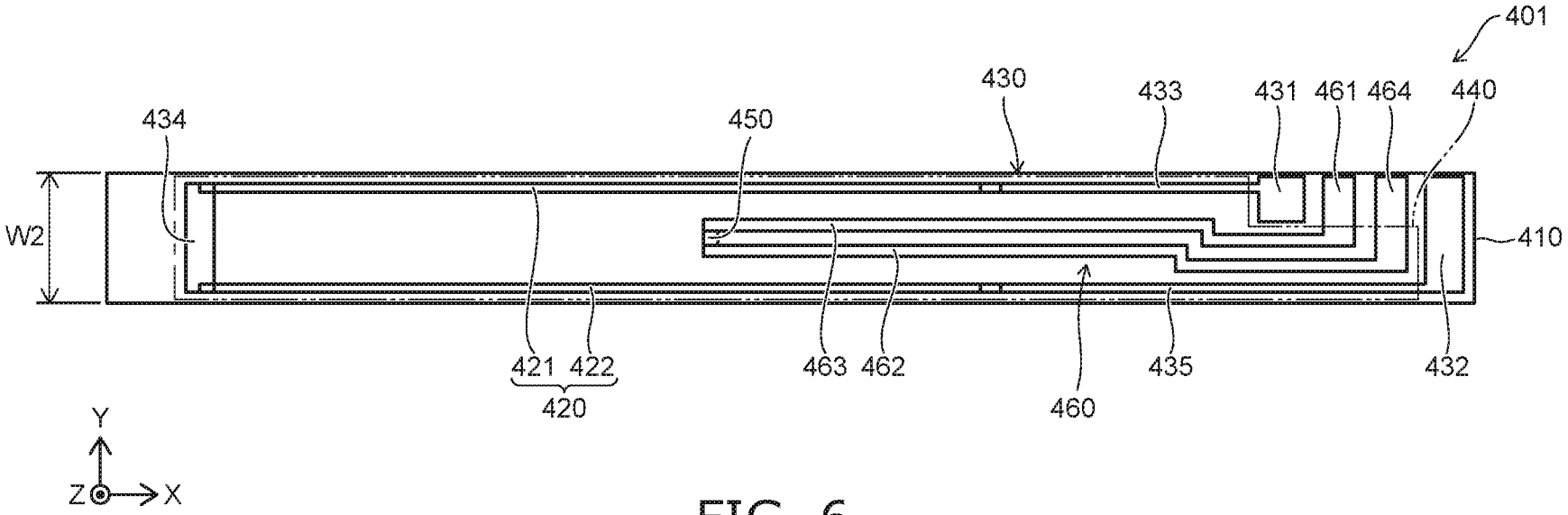
FIG. 6 is a schematic front view of the heater according to the comparative example.

FIG. 6 is a schematic front view illustrating a heater 401 according to a comparative example.

As illustrated in FIG. 6, a substrate 410, a heating section 420, a wiring section 430, an insulating section 440, a detecting section 450, and a wiring section 460 are provided in the heater 401.

The heating section 420 includes a heating element 421 and a heating element 422. The heating element 421 can be similar to the above-described heating element 21. The heating element 422 can be similar to the above-described heating element 22. The heating element 421 and the heating element 422 are provided on one surface of the substrate 410.

The wiring section 430 includes a terminal 431, a terminal 432, a wiring 433, a wiring 434, and a wiring 435. The terminal 431 can be similar to the above-described terminal 31. The terminal 432 can be similar to the above-described terminal 32. The wiring 433 can be similar to the above-described wiring 33. The wiring 434 can be similar to the above-described wiring 34. The wiring 435 can be similar to the above-described wiring 35. The terminal 431, the terminal 432, the wiring 433, the wiring 434, and the wiring 435 are provided on the surface provided with the heating section 420 in the substrate 410.

The insulating section 440 can be similar to the above-described insulating section 40. The insulating section 440 is provided on the surface provided with the heating section 420 in the substrate 410 and covers the heating section 420 (the heating elements 421 and 422) and a part (the wirings 433 to 435) of the wiring section 430. In this case, the terminals 431 and 432 can be exposed from the insulating section 440.

The detecting section 450 can be similar to the above-described detecting section 50.

The wiring section 460 includes a terminal 461, a terminal 464, a wiring 462, and a wiring 463. The terminal 461 can be similar to the above-described terminal 61. The wiring 462 can be similar to the above-described wiring 62. The wiring 463 can be similar to the above-described wiring 63.

However, the wiring section 460 is further provided with the terminal 464. The terminal 464 is provided side by side with the terminal 461 between the terminal 431 and the terminal 432. The terminal 464 is electrically connected to the detecting section 450 via the wiring 462.

In the heater 401 according to the comparative example, as illustrated in FIG. 6, the heating element 421, the heating element 422, the wiring 462, and the wiring 463 are provided side by side in the Y direction. In this case, in order to secure an appropriate dielectric strength, a predetermined distance needs to be provided between the heating element 421 and the wiring 463 and between the heating element 422 and the wiring 462. For that reason, a width dimension W2 of the substrate 410 and further the width dimension of the heater 401 increase. In recent years, it is desired to decrease the width dimension of the heater. The heater 401 according to the comparative example causes a new problem that the width dimension of the heater is difficult to decrease.

On the contrary, in the case of the heater 1 according to the present embodiment, as illustrated in FIG. 1, the terminal 61 is electrically connected to one end of the detecting section 50 via the wiring 62. The wiring 34 is electrically connected to the other end of the detecting section 50 via the wiring 63. In this case, the wiring 62 and the wiring 63 can be provided on a substantially straight line. For that reason, in the heater 1 according to the present embodiment, three linear bodies (the heating element 21, the heating element 22, and the wirings 62 and 63 provided on a substantially straight line) are provided side by side in the Y direction. As a result, a width dimension W1 of the substrate 10 and further the width dimension of the heater 1 can be further decreased even when a predetermined distance is provided between the heating element 21 and the wirings 62 and 63 and between the heating element 22 and the wirings 62 and 63.

As described above, according to the heater 1 of the present embodiment, the temperature controllability can be improved and an increase in the width dimension can be suppressed.

Here, for example, the controller 210 of the image forming apparatus 100 may be electrically connected to at least one of the terminal 61 and the terminals 31 and 32 at the time of the detection using the detecting section 50. That is, the terminal 31, the wiring 33, the heating element 21, the wiring 34, and the wiring 63 can be used as the terminals and wirings on one side connected to the detecting section 50. Further, the terminal 32, the wiring 35, the heating element 22, the wiring 34, and the wiring 63 can be used as the terminals and wirings on one side connected to the detecting section 50. Further, for example, when the terminal 31 and the terminal 32 are short-circuited, the wiring 33 and the heating element 21 and the wiring 35 and the heating element 22 can be electrically connected to the detecting section 50 via the wiring 34 and the wiring 63 while being connected in parallel.

In this case, the resistance value of the heating elements 21 and 22 is about several Ω. On the contrary, when the detecting section 50 is a thermistor, the resistance value is about several tens kΩ. For that reason, the influence on the measurement accuracy of the detecting section 50 is small even when the heating elements 21 and 22 are used as the wirings. In this case, for example, since the combined resistance can be decreased when the heating element 21 and the heating element 22 are connected in parallel by short-circuiting the terminal 31 and the terminal 32, the influence on the measurement accuracy of the detecting section 50 can be further decreased.

Figure 7:
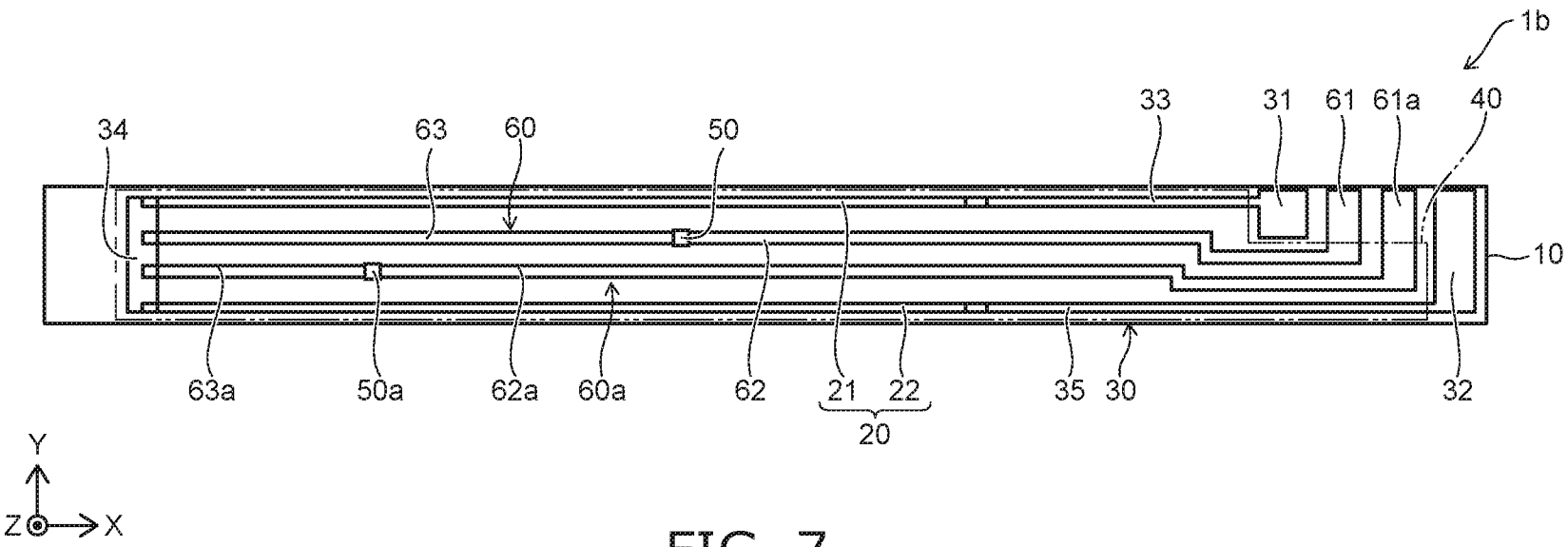
FIG. 7 is a schematic plan view for illustrating a heater according to another embodiment.

FIG. 7 is a schematic plan view for illustrating a heater 1*b* according to another embodiment.

As illustrated in FIG. 7, the substrate 10, the heating section 20, the wiring section 30, the insulating section 40, the detecting section 50, a detecting section 50*a*, the wiring section 60, and a wiring section 60*a* can be provided in the heater 1*b*.

That is, the detecting section 50, the wiring section 60 connected thereto, the detecting section 50*a*, and the wiring section 60*a* connected thereto can be provided in the heater 1*b*.

In this case, the detecting section 50*a* can be similar to the above-described detecting section 50. A terminal 61*a* can be similar to the above-described terminal 61. A wiring 62*a* can be similar to the above-described wiring 62. A wiring 63*a* can be similar to the above-described wiring 63. The terminal 61*a* can be provided between the terminal 31 and the terminal 32 side by side with the terminal 61. The terminal 61*a* can be electrically connected to the detecting section 50*a* via the wiring 62*a*. The wiring 34 can be electrically connected to the detecting section 50*a* via the wiring 63*a*.

That is, even when the plurality of detecting sections are provided, at least one of the heating element 21, the wiring and terminal connected to the heating element 21, the heating element 22, and the wiring and the terminal connected to the heating element 22 can be used as the terminal and wiring on one side connected to the detecting section. For that reason, an increase in the width dimension of the substrate 10 and further the width dimension of the heater can be suppressed even when the plurality of detecting sections are provided.

Additionally, as an example of a case in which the plurality of detecting sections are provided, a case in which two detecting sections are provided has been illustrated, but the same can be applied to a case in which three or more detecting sections are provided.

(Image Forming Apparatus)

Hereinafter, a case in which the image forming apparatus 100 according to the present embodiment is a copying machine will be described as an example. However, the image forming apparatus 100 according to the present embodiment is not limited to the copying machine, but may be the one having a heater for fixing a toner. For example, the image forming apparatus 100 may be a printer or the like.

Figure 8:
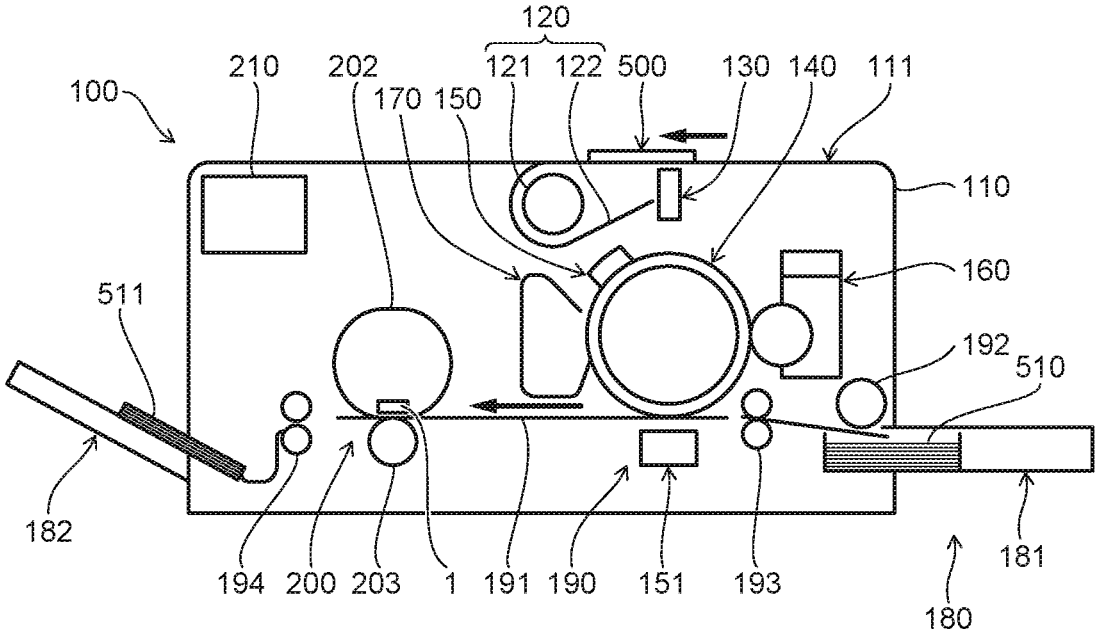
FIG. 8 is a schematic view for illustrating an image forming apparatus according to the present embodiment.

FIG. 8 is a schematic diagram for illustrating the image forming apparatus 100 according to the present embodiment.

Figure 9:
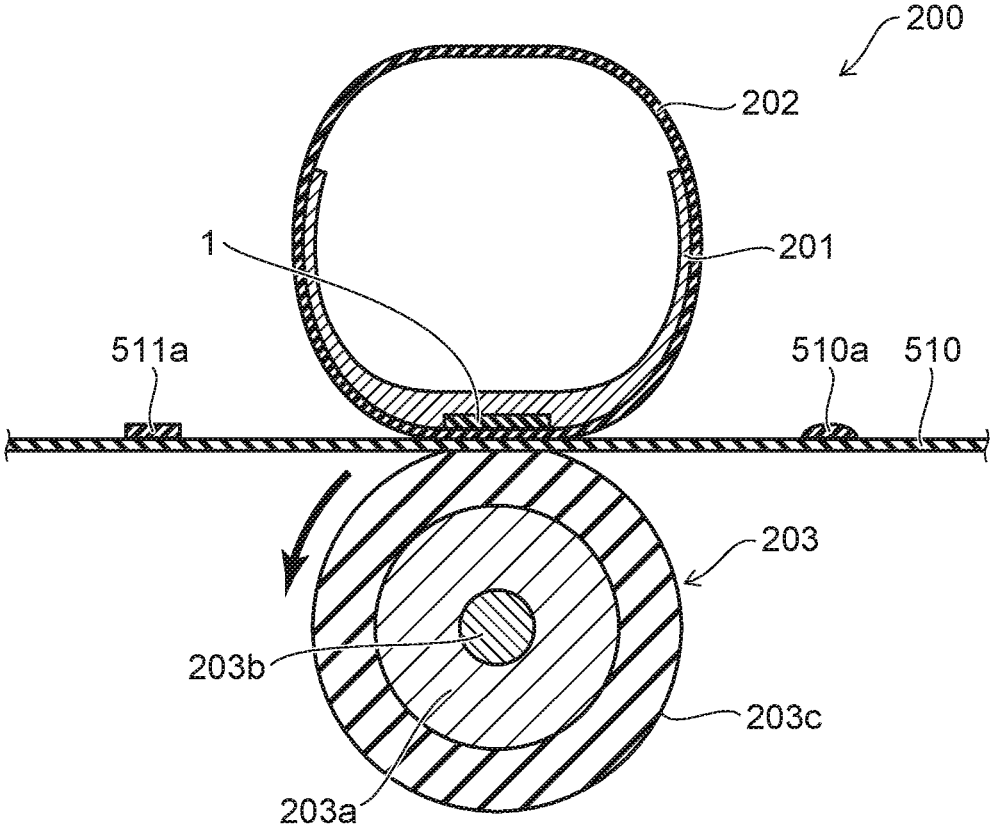
FIG. 9 is a schematic view for illustrating a fixing section.

FIG. 9 is a schematic diagram for illustrating a fixing section 200.

As illustrated in FIG. 8, the image forming apparatus 100 can be provided with a frame 110, an illuminating section 120, an imaging element 130, a photosensitive drum 140, a charging section 150, a discharging section 151, a developing section 160, a cleaner 170, a storage section 180, a conveying section 190, the fixing section 200, and the controller 210.

The frame 110 has a box shape and can store the illuminating section 120, the imaging element 130, the photosensitive drum 140, the charging section 150, the developing section 160, the cleaner 170, a part of the storage section 180, the conveying section 190, the fixing section 200, and the controller 210.

A window 111 formed of a translucent material such as glass can be provided on the upper surface of the frame 110. A document 500 to be copied can be placed on the window 111. Further, a moving section for moving the position of the document 500 can be provided.

The illuminating section 120 can be provided in the vicinity of the window 111. The illuminating section 120 can include a light source 121 such as a lamp and a reflecting mirror 122.

The imaging element 130 can be provided in the vicinity of the window 111.

The photosensitive drum 140 can be provided below the illuminating section 120 and the imaging element 130. The photosensitive drum 140 can be provided to be rotatable. For example, a zinc oxide photosensitive layer or an organic semiconductor photosensitive layer can be provided on the surface of the photosensitive drum 140.

The charging section 150, the discharging section 151, the developing section 160, and the cleaner 170 can be provided in the periphery of the photosensitive drum 140.

The storage section 180 can include a cassette 181 and a tray 182. The cassette 181 can be attached to one side portion of the frame 110 in an attachable and detachable manner. The tray 182 can be provided on the side portion opposite to the attachment side of the cassette 181 in the frame 110. The cassette 181 can store a sheet 510 (for example, a blank sheet) before being copied. The tray 182 can store a sheet 511 to which a copy image 511*a* can be fixed.

The conveying section 190 can be provided below the photosensitive drum 140. The conveying section 190 can convey the sheet 510 between the cassette 181 and the tray 182. The conveying section 190 can include a guide 191 which supports the conveyed sheet 510 and conveying rollers 192 to 194 which convey the sheet 510. Further, the conveying section 190 can be provided with a motor rotating the conveying rollers 192 to 194.

The fixing section 200 can be provided on the downstream side of the photosensitive drum 140 (the side of the tray 182).

As illustrated in FIG. 9, the fixing section 200 can include the heater 1, a stay 201, a film belt 202, and a pressing roller 203.

The heater 1 can be attached to a conveying line side of the sheet 510 in the stay 201. The heater 1 can be embedded in the stay 201. The installation side of the insulating section 40 of the heater 1 can be exposed from the stay 201.

The film belt 202 covers the stay 201 provided with the heater 1. The film belt 202 can contain, for example, a resin having heat resistance such as polyimide.

The pressing roller 203 can be provided to face the stay 201. The pressing roller 203 can include a cored bar 203*a*, a drive shaft 203*b*, and an elastic portion 203*c*. The drive shaft 203*b* can protrude from the end of the cored bar 203*a* and can be connected to a drive device such as a motor. The elastic portion 203*c* can be provided on the outer surface of the cored bar 203*a*. The elastic portion 203*c* can be formed of an elastic material having heat resistance. The elastic portion 203*c* can contain, for example, a silicone resin or the like.

The controller 210 can be provided inside the frame 110. The controller 210 can include, for example, an arithmetic section such as a central processing unit (CPU) and a storage section storing a control program. The arithmetic section can control the operation of each component provided in the image forming apparatus 100 on the basis of the control program stored in the storage section. Further, the controller 210 can also include an operation section for a user to input copying conditions and the like, a display section for displaying an operation state, an abnormal display, and the like, and the like.

For example, the controller 210 controls a drive device to move the document 500 placed on the window 111. The controller 210 controls the charging section 150 to uniformly charge the photosensitive drum 140. The controller 210 controls the illuminating section 120 to irradiate the document 500 with light. The controller 210 controls the imaging element 130 to expose the reflected light from the document 500 onto the photosensitive drum 140. For example, the controller 210 controls the imaging element 130 to form an electrostatic latent image on the charged photosensitive drum 140. The controller 210 controls the developing section 160 to develop the electrostatic latent image, that is, to form a toner image 510*a*.

The controller 210 controls the conveying roller 192 to take the sheet 510 from the cassette 181. The controller 210 controls the conveying roller 193 to supply the sheet 510 taken from the cassette 181 to the photosensitive drum 140. The controller 210 controls the conveying roller 193 to synchronize the feeding of the sheet 510 by the conveying roller 193 with the rotation of the photosensitive drum 140. The controller 210 controls the discharging section 151 to transfer the toner image 510*a* of the photosensitive drum 140 to the sheet 510. After the toner image 510*a* is transferred, the toner remaining on the photosensitive drum 140 is removed by the cleaner 170. The controller 210 controls the conveying roller 193 to supply the sheet 510 to which the toner image 510*a* is transferred to the fixing section 200.

The controller 210 controls the fixing section 200 (the heater 1) to fix the toner image 510*a* to the sheet 510. The controller 210 detects a change in the resistance value of the detecting section 50 and further the temperature of the heater 1. When the controller 210 determines that the temperature of the heater 1 is within an appropriate range, the operation of the image forming apparatus 100 can be continued. When the controller 210 determines that the temperature of the heater 1 is not appropriate, the power applied to the heater 1 can be controlled so that the temperature of the heater 1 falls within an appropriate range. In this way, appropriate heating can be performed.

The toner image 510*a* is heated and melted to become the copy image 511*a* at a position where the heater 1 contacts the elastic portion 203*c* of the pressing roller 203 with the film belt 202 interposed therebetween. The copy image 511*a* emits heat while being sent from the fixing section 200 to the tray 182 to be fixed to the sheet 510.

The controller 210 controls the conveying roller 194 and stores the sheet 511 to which the copy image 511*a* is fixed in the tray 182.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A heater comprising:

a substrate;

a first heating element which is provided on one surface of the substrate and extends in a longitudinal direction of the substrate;

a second heating element which is provided on one surface of the substrate, extends in the longitudinal direction of the substrate, and is provided side by side with the first heating element in a direction orthogonal to the longitudinal direction;

a first detecting section which is provided on one surface of the substrate and detects a temperature;

a wiring which is electrically connected to one end of the first heating element, one end of the second heating element, and one end of the first detecting section;

a first terminal which is electrically connected to the other end of the first heating element;

a second terminal which is electrically connected to the other end of the second heating element; and a third terminal which is electrically connected to the other end of the first detecting section, the first terminal, the second terminal, and the third terminal being provided in the vicinity of one end of the substrate in the longitudinal direction of the substrate, and the wiring is provided in the vicinity of the other end of the substrate.

2. The heater according to claim 1, wherein a planar shape of the substrate is an elongated rectangular shape.

3. The heater according to claim 1, wherein a length of the second heating element in the longitudinal direction of the substrate is the same as a length of the first heating element in the longitudinal direction of the substrate.

4. The heater according to claim 1, wherein the second heating element is provided in parallel to the first heating element.

5. The heater according to claim 1, wherein a position of the one end of the second heating element is the same as a position of the one end of the first heating element in the longitudinal direction of the substrate.

6. The heater according to claim 1, wherein a position of the other end of the second heating element is the same as a position of the other end of the first heating element in the longitudinal direction of the substrate.

7. The heater according to claim 1, wherein the first heating element and the second heating element contain at least one of ruthenium oxide ($RuO_2$) and silver-palladium (Ag—Pd) alloy.

8. The heater according to claim 1, wherein the first terminal, the second terminal, and the third terminal are provided side by side in the longitudinal direction of the substrate.

9. The heater according to claim 8, wherein the third terminal is provided between the first terminal and the second terminal.

10. The heater according to claim 1, wherein the first detecting section is a film thermistor.

11. The heater according to claim 10, wherein the first detecting section contains at least one of barium titanate, nickel oxide, manganese oxide, cobalt oxide, and iron oxide.

12. The heater according to claim 1, wherein the first detecting section is provided between the first heating element and the second heating element in the direction orthogonal to the longitudinal direction.

13. The heater according to claim 1, wherein the first detecting section is provided in the vicinity of a center of a region provided with the first heating element and the second heating element.

14. A heater comprising:

a substrate;

a first heating element which is provided on one surface of the substrate and extends in a longitudinal direction of the substrate;

a second heating element which is provided on one surface of the substrate, extends in the longitudinal direction of the substrate, and is provided side by side with the first heating element in a direction orthogonal to the longitudinal direction;

a first detecting section which is provided on one surface of the substrate and detects a temperature;

a wiring which is electrically connected to one end of the first heating element, one end of the second heating element, and one end of the first detecting section;

a first terminal which is electrically connected to the other end of the first heating element;

a second terminal which is electrically connected to the other end of the second heating element;

a third terminal which is electrically connected to the other end of the first detecting section;

a second detecting section which is provided on one surface of the substrate and detects a temperature; and a fourth terminal which is electrically connected to the other end of the second detecting section, wherein the one end of the first heating element, the one end of the second heating element, the one end of the first detecting section, and one end of the second detecting section are electrically connected to the wiring.

15. The heater according to claim 14, wherein the second detecting section is a film thermistor.

16. The heater according to claim 14, wherein the second detecting section contains at least one of barium titanate, nickel oxide, manganese oxide, cobalt oxide, and iron oxide.

17. The heater according to claim 14, wherein the first terminal, the second terminal, the third terminal, and the fourth terminal are provided side by side in the longitudinal direction of the substrate.

18. An image forming apparatus comprising:

a heater, the heater including:

a substrate;

a first heating element which is provided on one surface of the substrate and extends in a longitudinal direction of the substrate;

a second heating element which is provided on one surface of the substrate, extends in the longitudinal direction of the substrate, and is provided side by side with the first heating element in a direction orthogonal to the longitudinal direction;

a detecting section which is provided on one surface of the substrate and detects a temperature;

a wiring which is electrically connected to one end of the first heating element, one end of the second heating element, and one end of the detecting section;

a first terminal which is electrically connected to the other end of the first heating element;

a second terminal which is electrically connected to the other end of the second heating element; and a third terminal which is electrically connected to the other end of the detecting section, wherein the first terminal, the second terminal, and the third terminal are provided in the vicinity of one end of the substrate in the longitudinal direction of the substrate, and the wiring is provided in the vicinity of the other end of the substrate.

19. The image forming apparatus according to claim 18, further comprising:

a controller which controls power applied to at least one of the first heating element and the second heating element based on a change in a resistance value of the detecting section, wherein when detecting the change in the resistance value of the detecting section, the controller is electrically connected to at least one of the third terminal and the first and second terminals.

* * * * *